US006332781B1

(12) United States Patent
Ito

(10) Patent No.: US 6,332,781 B1
(45) Date of Patent: Dec. 25, 2001

(54) CONNECTOR STRUCTURE HAVING DUST/WATER DROPLET DAMAGE PREVENTION CAPABILITY

(75) Inventor: Hidetaka Ito, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/544,297

(22) Filed: Apr. 6, 2000

(51) Int. Cl.[7] ..... H01R 33/00

(52) U.S. Cl. ..... 439/34; 439/138; 439/206; 439/819

(58) Field of Search ..... 439/34, 138, 82, 439/206, 819, 821, 822, 857, 860, 846, 852, 863, 864, 135

(56) References Cited

U.S. PATENT DOCUMENTS

| | | | | |
|---|---|---|---|---|
| 4,634,210 | * | 1/1987 | Crawford | 339/176 |
| 4,968,271 | * | 11/1990 | Buscella | 439/860 |
| 5,941,741 | * | 8/1999 | Dobbelaere et al. | 439/852 |
| 6,135,784 | * | 10/2000 | Pei | 439/70 |

FOREIGN PATENT DOCUMENTS 57-47444 3/1982 (JP) .

* cited by examiner

*Primary Examiner*—Paula Bradley
*Assistant Examiner*—Truc Nguyen
(74) *Attorney, Agent, or Firm*—Armstrong, Westerman, Hattori, McLeland & Naughton, LLP

(57) ABSTRACT

A connection structure for power supply to a vehicle door comprising a door side connector 4 and a body side connector 3, either one of the door side connector and the body side connector being provided with female terminals 9 and the other connector being provided with male terminals 28, each of the female terminals including contact members 14 having a pair of contact portions 15 which are biased in a closing direction by means of a spring member 22 and adapted to be opened and closed in a horizontal direction, and each of the male terminal 28 being inserted between a pair of the contact portions. A pair of the contact portions are provided with shutters 12 respectively at their forward ends, and the shutters are closed when the contact portions are closed thereby to close an opening 11 formed in the connector 3 for receiving the male terminal. The connector 3 may be provided with openings for draining water and removing dusts. The female terminal 9 is rotatably supported about a support shaft 21. A pair of hinge portions 17 of the female terminal through which a support shaft 21 passes are pressed by a spring tension against an electrode 31 in the connector, and the electrode is connected to either of a door side circuit and a body side circuit. The male terminal 28 may be biased by a spring in a projecting direction with a larger force than a force of inserting it into the female terminal.

6 Claims, 10 Drawing Sheets

FIG. 1
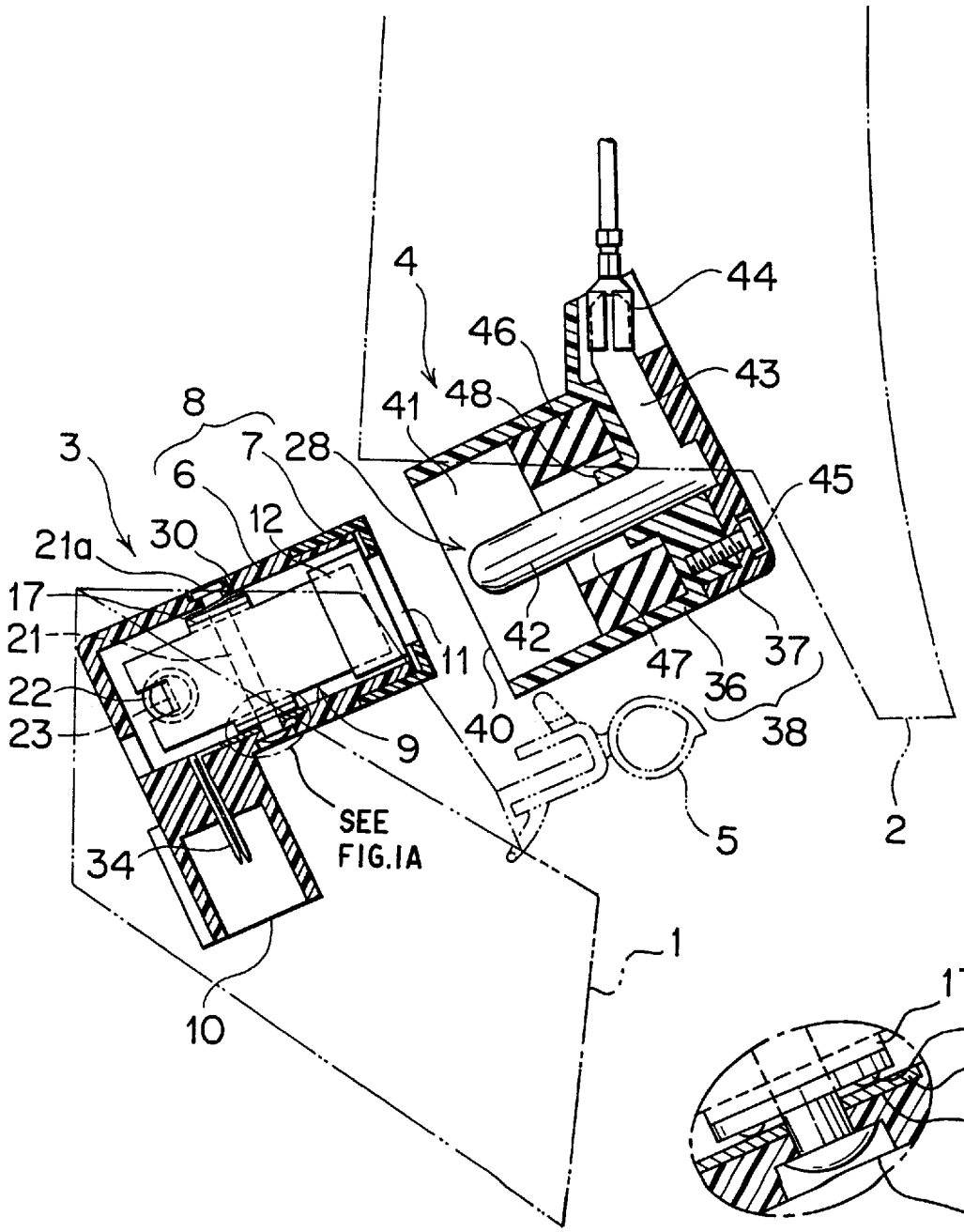
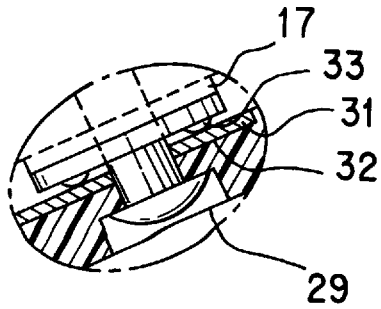
FIG.1A

CONNECTOR STRUCTURE HAVING DUST/WATER DROPLET DAMAGE PREVENTION CAPABILITY

BACKGROUND OF THE INVENTION

1. Field of the Invention

The present invention relates to a connection structure for power supply to a vehicle door which supplies an electric power of a vehicle body to auxiliary members in a back door, etc. of an automobile.

2. Description of the Related Art

Generally, various auxiliary members such as a rear wiper motor, a defogger, a door lock, etc. are mounted on a back door of an automobile, and there have been proposed a number of connection structures for power supply to a vehicle door.

FIG. 14 shows a conventional connection structure for power supply to the vehicle door as described in Japanese Utiltiy Model Publication No. 57-47444 of an unexamined application. As seen in FIG. 14, a plurality of pin-like movable terminals 121 are provided on a back door 120 of a vehicle so as to be retractable by means of coil springs 122, and contact terminals 124 are provided on a vehicle body 123 so as to face with tip ends 121*a* of the movable terminals 121 respectively.

Each of the movable terminals 121 is exposed only at its tip end 121*a*, and all the other area is covered with an insulating holder 125. One ($\mathbf{124}_1$) of the contact terminals 124 has a cancel switch mechanism 127 which is biased by a coil spring 126 so as not to contact with a contact 128 when the door is open. The contact terminals 124 are pressed into contact with the movable terminal 121 when the door is closed, and the contact terminal $\mathbf{124}_1$ comes in contact with the contact 128 thereby to connect a power source side circuit 130 to a circuit (not shown) of the auxiliary devices.

However, the back door 120, which communicates with a trunk space must be frequently opened and closed, and there has been a problem in the above described structure that, due to the exposed contact faces of the terminals 121 and 124, baggage may interfere with the contact faces, or sand, dust water drops, or other foreign articles, may enter between the contact faces of the terminals, thus resulting in a faulty electrical connection. In other words, due to the structure wherein the 15 terminals 121, 124 face with each other to contact, dust, or the like, can accumulate between the contact faces because they are not cleaned when an erosion has occurred or the foreign articles are adhered to the contact faces, and therefore, a defective contact may occur. Because the contact terminal 124, particularly at the vehicle side, is exposed and always supplied with an electric voltage, it has been necessary to provide an electric power shut off mechanism (for example, a cancel switch mechanism) in order to avoid a short circuit which will be caused by a contact with a conductive foreign article. This has inevitably made the structure complicated. Further, the movable terminal 121 is liable to be displaced radially and inclined on occasion of contacting, due to its long size. Therefore, the contact area of the contact terminal 124 must be large in order to obtain a reliable contact even in such cases. In addition, when a contact 129 is inclined and displaced, there has been a fear that contactability of the cancel switch mechanism 127 may deteriorate and cause a faulty contact. Still further, in order to deal with an overstroke when the back door 120 is closed with a strong force, the movable terminal 121 must have an ample space for the stroke, which results in an increase in the size of the structure.

SUMMARY OF THE INVENTION

In view of the above described drawbacks of the conventional art, it is an object of the present invention to provide a connection structure for connecting a power supply to a vehicle door in which the contact faces are maintained in a good condition by eliminating attachment or accumulation of dust or water drops thereon, the contact faces are protected from an interference with the exterior, and the structure will not be upsized to cope with the overstroke, and which are free from faulty contacts caused by radial displacements of the contact portions.

In order to attain the above described object, there is provided, according to the invention, a connection structure for connecting a power supply to a vehicle door comprising a door side connector and a body side connector to be engaged with each other to connect door side and body side electric circuits, characterized in that either one of the door side connector and the body side connector is provided with female terminals and the other connector is provided with male terminals, each of the female terminals including contact members having a pair of contact portions which are biased in a closing direction by means of a spring member and adapted to be opened and closed in a horizontal direction, each of the male terminals being inserted between a pair of the contact portions.

According to a second aspect of the invention, a pair of the contact portions are provided with shutters at their respective forward ends, and the shutters are closed when the contact portions are closed thereby filling an opening formed in the connector for receiving the male terminal .

According to a third aspect of the invention, the connector is provided with openings for draining water and removing dust from beneath the contact portions and the shutters.

According to a fifth aspect of the invention, the female terminal includes a pair of hinge portions which are pressed by a spring tension against an electrode in the connector, and the electrode is connected to either of said door side circuit and said body side circuit.

According to a sixth aspect of the invention, the male terminal is biased by a spring in a projecting direction with a larger force than a force for inserting it into the female terminal and is retractable on occasion of an interference.

BRIEF DESCRIPTION OF THE DRAWINGS

FIG. 1 is a side view in a vertical section showing a first embodiment of a connection structure for power supply to a vehicle door according to the invention;

DESCRIPTION OF THE PREFERRED EMBODIMENTS

Figure 2:
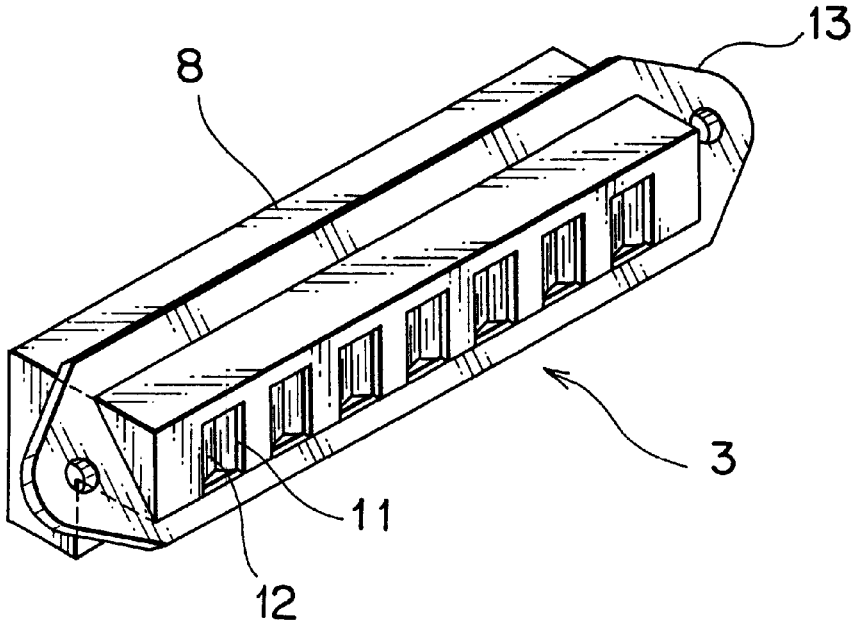
FIG. 2 is a perspective view showing a vehicle body side connector.

Now, preferred embodiments of the present invention will be described by way of examples referring to the drawings.

FIGS. 1 to 10 show a first embodiment of the connection structure for power supply to the vehicle door according to the invention.

In FIG. 1, reference numeral 1 represents a vehicle body, 2 represents a back door of the vehicle, 3 represents a body side connector (a body side switch) provided in the vehicle body, 4 represents a door side connector (a door side switch) provided on the back door, and 5 represents a weather strip for water proofing.

The body side connector 3 of a male type includes a case 6 formed of a synthetic resin, a plurality of female terminals 9 contained in the case 6, and a cover 7 formed of a synthetic resin and mated with a front part of the case 6. The case 6 and the cover 7 constitute a housing 8. A female connector part 10 to be connected to a power source wire is integrally provided in a backward half of the body side connector 3.

As shown in FIG. 2, the body side connector 3 has a plurality of openings 11 in parallel into which a plurality of male terminals are adapted to be inserted. Inside the openings 11 are contained the female terminals 9 respectively. The openings 11 are respectively closed by a plurality of shutters 12 which will be described later. The housing 8 is fixed to the vehicle body 1 (FIG. 1) by means of a slanted flange 13.

Figure 3:
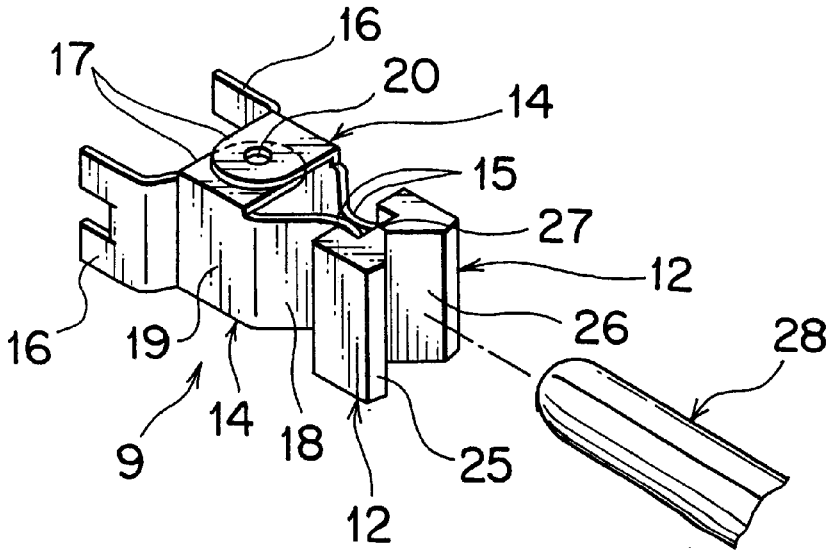
FIG. 3 is an exploded perspective view showing a female terminal to be provided in the connector and a male terminal to be mated therewith.

As shown in FIG. 3, each of the female terminals 9 is composed of a pair of contact members 14, 14 which are able to be opened and closed. The contact members 14 have curved contact portions 15 at one end, spring receiving portion 16 at the other end, and hinge portions 17 at an intermediate area respectively. The contact portions 15 are adapted to be drawn into contact and separated in opposite directions (horizontally) around the hinge portions 17. At forward ends of the contact portions 15 are provided the shutters 12 formed of an insulating resin.

Each of the contact portions 15 is integral with an upright side plate 19 through a slanted portion 18. The hinge portions 17 horizontally project from upper and lower ends of the side plate 19 and are C-shape in a vertical section. The lower hinge portion 17 projecting from the lower end of the side plate 19 is not shown in FIG. 3. The hinge portions 17 extending from both the side plates 19 are stacked one on another, and are formed with an axial bore 20 in the center thereof through which a support pin (a support shaft) 21 is passed (FIG. 1). The hinge portions 17 at the lower position are also stacked in the same manner as the upper hinge portions. The left and right contact members 14, 14, which are in the same shape, can be employed for common use.

As shown in FIG. 3, in the rear of the side plates 19, are respectively formed the spring receiving portions 16 which are larger in width than the side plates 19. A compression coil spring 22 (a spring member) is resiliently mounted between the left and the right spring receiving portions 16, 16. The spring receiving portions 16, 16 are outwardly biased by means of the compression coil spring 22 whereby the left and the right contact portions 15, 15 come into contact with each other so as to clamp the male terminal. The compression coil spring 22 is supported with its inner periphery engaged with cut up pieces 23, for example, which are formed in the spring receiving portions 16.

In FIG. 3, a pair of shutters 12, 12 are respectively fixed to forward ends of the contact portions 15, 15 to be opened and closed integrally with the contact portions 15. A tip end of each of the contact portions 15 is bent in right angle at 24 and extends forwardly as shown in FIG. 6. To the bent portion 24 is fixed the shutter 12. As shown in FIG. 3, each of the shutters 12 has a narrow distal face 25, a guide face 26 inwardly tapered from the distal face 25, and a closed face 27 to be abutted to a counterpart closed face 27 at an inner end of the guide face 26. The distal face 25 is slightly slanted outwardly. Both the closed faces 27 are tight-fitted to each other when both the contact portions 15 are brought into contact, thereby preventing dusts or water drops from intruding into the contact portions 15 from the openings 11 of the housing 8 (FIG. 2). A male terminal 28 is inserted into the contact portions 15 through the guide faces 26.

Because the contact portions 15 are opened in the left and right directions (in a horizontal direction) but not in the upward and downward directions (in a vertical direction), the dusts and abrasion powders, etc. will fall in a vertical direction from the contact faces between the contact portions 15. In addition, the contact faces are cleaned by sliding movements of the male terminal 28 in both directions of insertion and retraction. Accordingly, the contact faces are always kept clean.

The shutter 12 is formed larger than the opening 11 of the housing 8 and will securely close the opening 11 as shown in FIG. 1. The support pin 21 passes through the upper and the lower hinge portions 17 and is received in axial bores 29 formed in an upper and a lower walls of the case 6. The support pin 21 has a head 21*a* at one end, and the other end is caulked or bent after the insertion. The female terminal 9 is set in the case 6 while the front cover 7 is detached.

A bellville spring 30 is resiliently mounted between the hinge portion 17 and the case 6 at a side of the head 21*a* of the support pin 21. The bellville spring 30 biases the hinge portions 17 downwardly to bring the lower hinge portion 17 into contact with an electrode 31 with a sufficient contact pressure. The electrode 31 is fitted and fixed in a groove 32 in a bottom wall of the case 6. The hinge portion 17 may be provided with contacts 33 which project toward the electrode 31. The electrode 31 is bent in right angle and extends as a tab terminal 34 in the female connector part 10. The tab terminal 34 is incorporated in the case 6 by integral molding or pressure fitting.

In FIG. 1, the door side connector 4 of a female type includes a case 36 formed of a synthetic resin, a plurality of male terminals 28 inserted into the case 36 from the back, and a cover 37 fastened to a rear part of the case 36. The case 36 and the cover 37 constitute a housing 38. The housing 38 has an insertion hole 40 which is larger relative to the body side housing 8 to prevent an interference between the housings 8 and 38 along with a rotation of the back door 2. Each of the male terminals 28 includes an electric contact portion 42 in a shape of a flat plate projecting into a connector insertion chamber 41 and the other electric contact portion 43 in a shape of a flat plate which is bent in right angle from a base portion of the electric contact portion 42 and extends upward in a rather slanted shape. The one electric contact portion 42 is adapted to be connected to the female terminal 9, while the other electric contact portion 43 is connected to a wired terminal 44 at the door side.

The male terminal 28 may be integrally formed with the case 36 by molding, and the electric contact portion 42 may be in a columnar shape. The cover 37 is fixed to the case 36 by means of small screws 45. Inside the connector insertion chamber 41 is provided a shock absorbing cushion 46 of urethane rubber or the like for the body side connector 3. The cushion 46 has a hollow portion 47 which is rather larger in diameter than the opening 11 in the body side connector 3. A boss 48 of the cover 36 is seated inside the hollow portion 47, and the electric contact portion 42 of the male terminal 28 projects forwardly from the boss 48 beyond the cushion 46.

Figure 4:
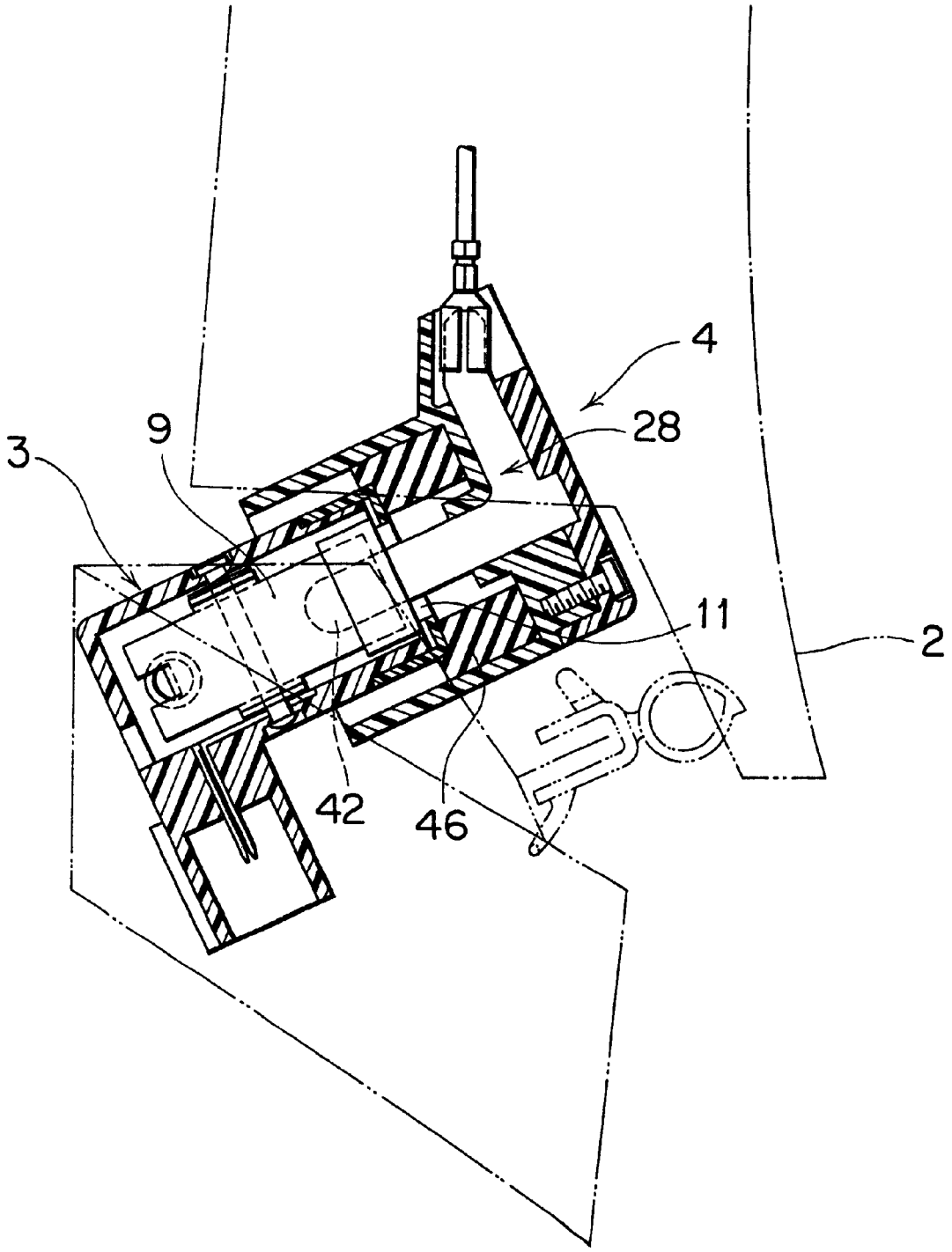
FIG. 4 is a side view in a vertical section showing the connection structure when a back door is closed.
Figure 5:
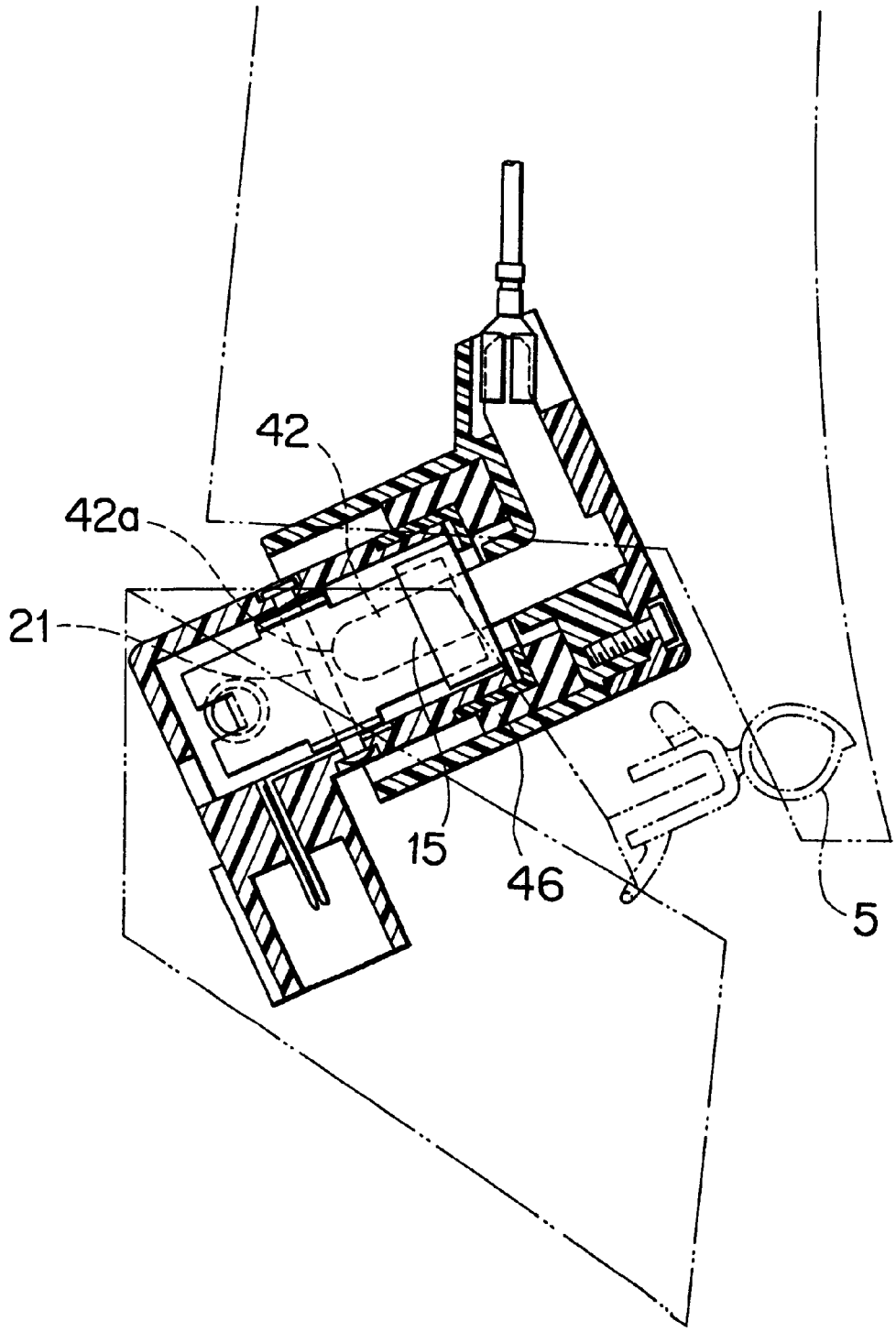
FIG. 5 is a side view in a vertical section showing the connectors in the connected state when they are overstroked.

FIGS. 4 and 5 show both the connectors in conditions where the back door 2 is closed from the condition in FIG. 1. FIG. 4 shows an ordinarily closed position and FIG. 5 shows a condition where the connectors have been overstroked by an inertia from the condition in FIG. 4. The connectors can be immediately restored from the condition in FIG. 5 to the condition in FIG. 4 by counterforces of the weather strip 5 and the cushion 46. In the closed state, the cushion 46 sealingly contacts a front end of the body side connector 3 thereby preventing intrusion of dust or water drops into the opening 11.

Figure 14:
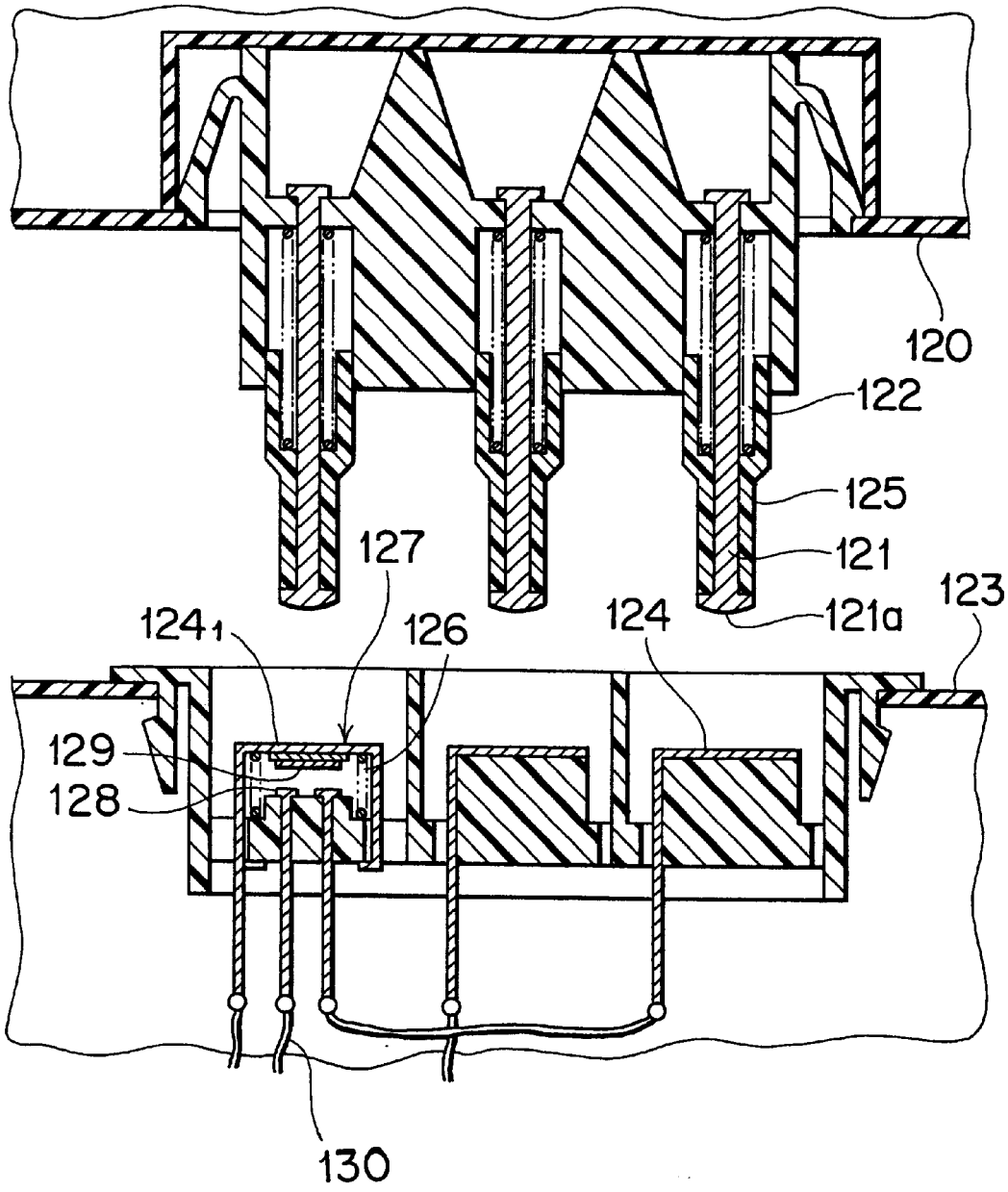
FIG. 14 PRIOR ART
FIG. 14 is a plan view in a longitudinal section showing a conventional structure.

In the ordinary closed state in FIG. 4, the one electric contact portion 42 of the male terminal 28 is positioned substantially midway between a front end of the female terminal 9 and the support pin 21. In the overstroked state in FIG. 5, a forward end 42*a* of the electric contact portion 42 stops in front of the support pin 21. For this eventuality, the position of the support pin 21 is set (a distance from the contact portion 15 to the support pin 21). In the conventional structure as shown in FIG. 14, the overstroke has been dealt with by the retraction of the door side movable terminals compressing the coil springs. However, in the connection structure according to the invention, there is no need of providing the movable mechanism, nor stroke spaces for the terminals, as in the conventional structure, and the spaces inside the door and the vehicle body can be saved.

FIGS. 6A to 6D are plan views sequentially showing the states wherein the male terminal and the female terminal are connected along with the closing action of the back door.

Figure 6A:
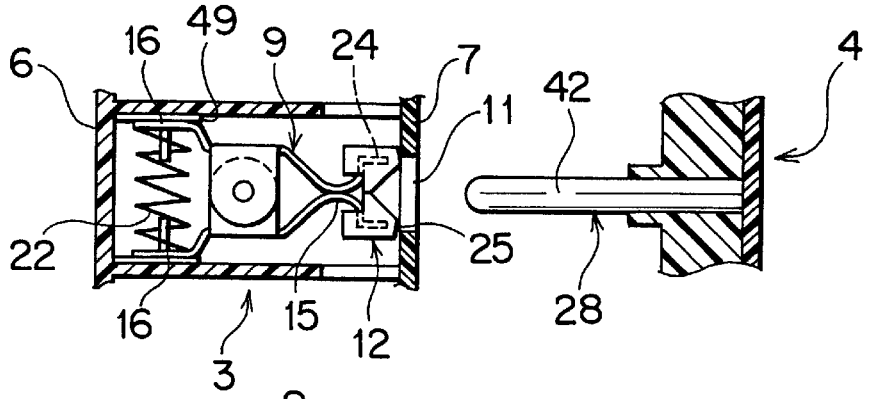
FIGS. 6A to 6D are plan views in a longitudinal section sequentially showing the states wherein the male terminal is connected to the female terminal.

In the unconnected state in FIG. 6A (when the door is open), the forward faces 25 of the shutters 12 are in contact with an edge of the opening 11 in the cover 7 thus preventing an intrusion of the dusts, etc. from the exterior. A pair of the spring receiving portions 16 of the female terminal 9 are biased outwardly by means of the compression coil spring 22 and brought into contact with walls 49 projecting from the case 6. This will prevent the contact portions 15 and the shutters 12 from being pressed with an excess force. Accordingly, a force for inserting the terminal is not applied more than required, and good insertibility of the electric contact portion 42 of the male terminal 28 into the female terminal 9 can be obtained. A pair of the contact portions 15 and the shutters 12 are sealingly closed to prevent an intrusion of the dusts into the contact portions 15.

Figure 6B:
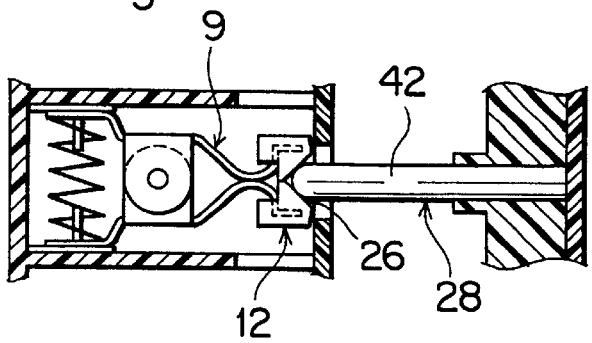
Figure 6C:
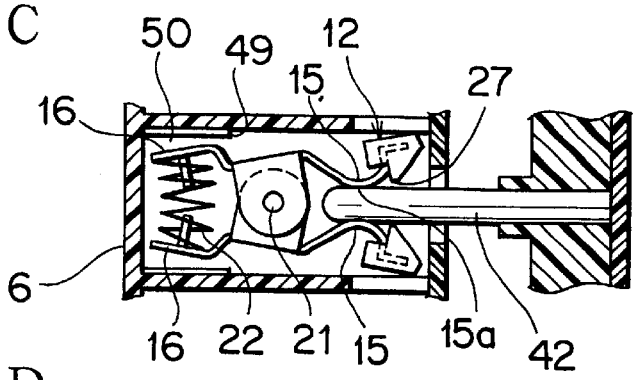

As shown in FIG. 6B, along with the closing action of the back door, the forward end of the electric contact portion 42 of the male terminal 28 comes into contact with the slanted guide faces 26 of the shutter 12 to be introduced into the female terminal 9. A pair of the contact portions 15, 15 are opened rotating about the support pin 21 as shown in FIG. 6C to receive the electric contact portion 42 between the contact portions 15, 15, and simultaneously, a pair of the spring receiving portions 16, 16 move into a closed state while compressing the compression coil spring 22. The electric contact portion 42 is clamped between the left and the right contact portions 15, 15 by the force of the compression coil spring 22 to obtain a sufficient contact pressure against the contact faces 15*a*. The spring receiving portions 16 are separately located with ample clearances 50 with respect to the projecting walls 49 of the case 6.

Figure 6D:
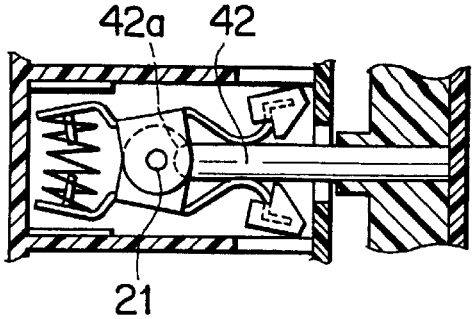

While the male and female terminals 28, 9 are in contact with each other, the closed faces 27 of the shutters 12 are not in contact with the electric contact portion 42 to avoid useless sliding motion, so that an increase in the insertion force and abrasion of the shutter 12 are prevented. On occasion of the overstroke as shown in FIG. 6D, the distal end 42*a* of the electric contact portion 42 is inserted up to a position just in front of the support pin 21 and does not abut against the support pin 21. The members are so dimensioned.

Figure 7:
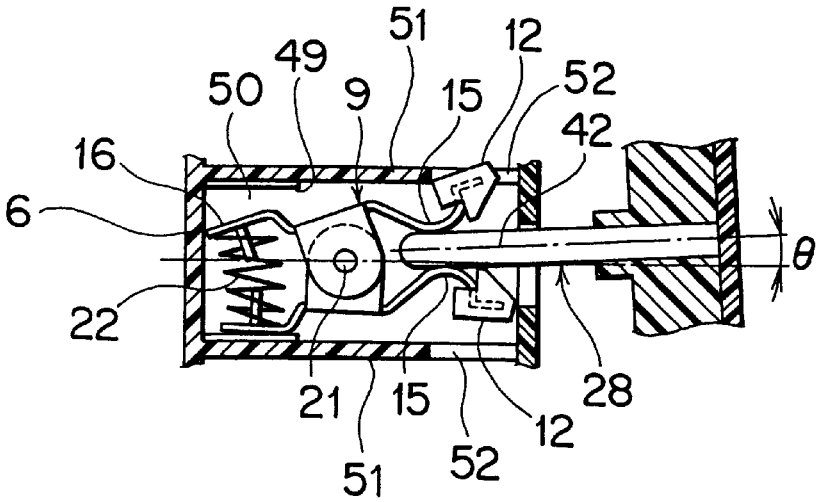
FIG. 7 is a plan view in a longitudinal section showing the connected state wherein both the terminals are radially displaced.

When the electric contact portion 42 of the male terminal 28 has been displaced at an angle θ relative to the female terminal 9 as shown in FIG. 7, the displacement is absorbed by rotating the male terminal 9 about the support pin 21, so that the terminals 9,28 can be reliably connected. Both side faces 51, 51 of the case 6 are respectively provided with relief openings 52, 52 for the shutters 12, 12 to afford a large rotation angle of the shutters 12, 12. Because ample clearances 50 are provided between the spring receiving portion 16 and the projecting wall 49 of the case 6, a large rotation angle of the spring receiving portion 16 can be also secured.

Further, because the coil spring 22 does not abut against the projecting wall 49 of the case 6 but is held between the spring a receiving portions 16, 16, the rotation of the female terminal 9 can be easily performed without any obstruction, and therefore, centering of the terminals 9 and 28 can be surely attained. Even in case where a pair of the contact portions 15, 15 are designed to be opened vertically about a horizontally located support pin 21 but not laterally, this centering mechanism will absorb swinging angle of the door, and a smooth connection can be attained.

Figure 8:
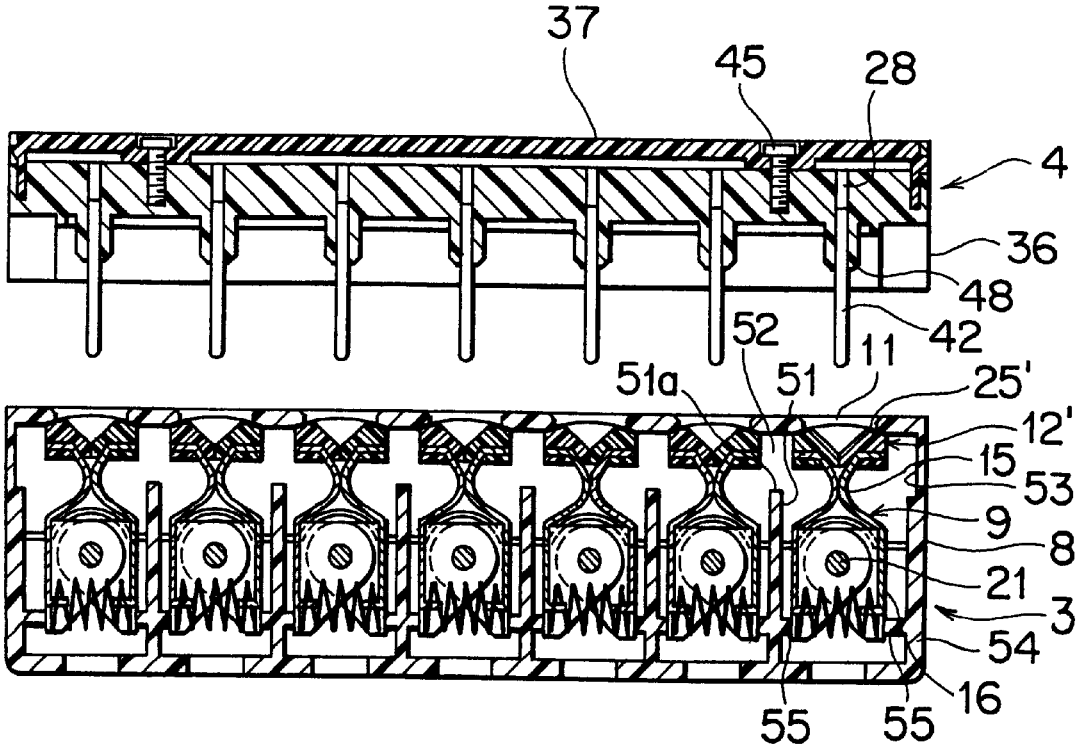
FIG. 8 is a plan view in a longitudinal section showing both the connectors having a plurality of terminals respectively before they are connected (when the door is open)
Figure 9:
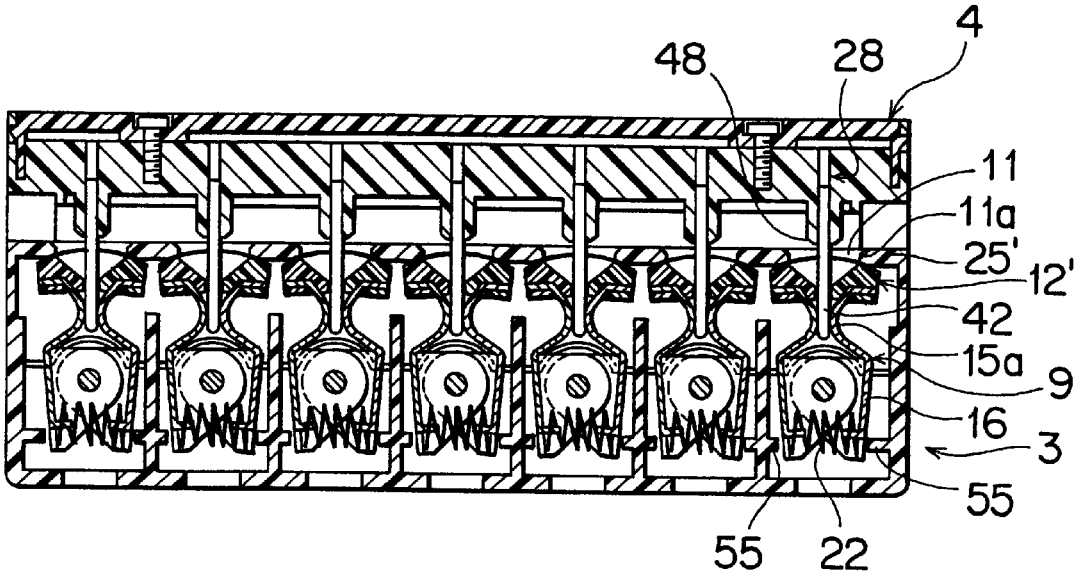
FIG. 9 is a plan view in a longitudinal section showing both the connectors in the connected state when the door is closed.
Figure 10:
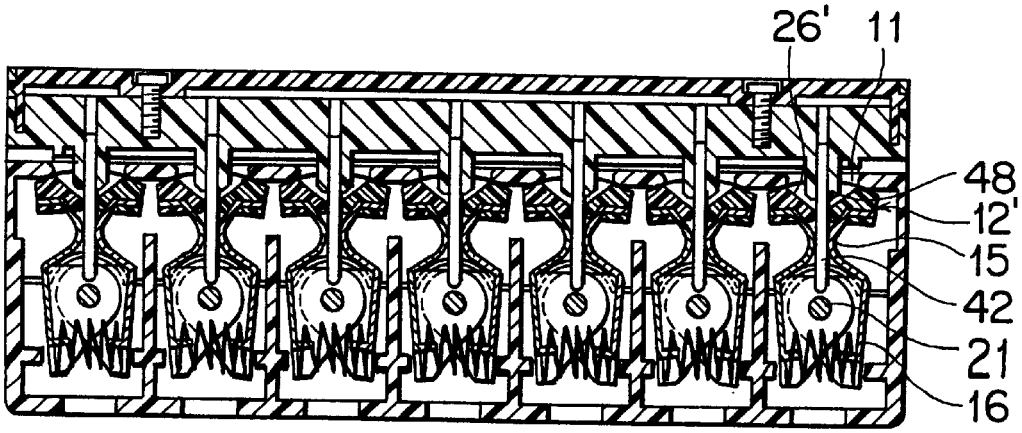
FIG. 10 is a plan view in a longitudinal section showing both the connectors in the connected state when the door is over stroked.

FIGS. 8 to 10 sequentially show the body side connector 3 having a plurality of the same terminal containing chambers as shown in FIG. 2 and the door side connector 4 while they are connected to each other.

In this embodiment, as seen in FIG. 8 (a condition where the door is open), the seven female terminals 9 are arranged in parallel at an equal pitch in the body side housing 8. The electric contact portions 42 of the male terminals 28 are similarly arranged in the door side case 36 correspondingly to the female terminals 9. The housing 8 has partition walls 51 for separating the female terminals 9 which correspond to the case walls 51 in FIG. 7. The relief openings 52 for the shutter 12' are provided in the forward ends of the partition walls 51 and relief grooves 53 are formed at opposite ends of the housing 8. The forward end 51*a* of the partition wall 51 extends up to the same position as the contact portions 15.

In this embodiment, the spring receiving portions 16 of the female terminal 9 are accurately positioned and supported by being abutted against support projections 55 which project from the partition walls 51 and the side walls 54 of the housing 8. The forward end 25' of the shutter 12' in a form of an arc having a center of radius at the support pin 21 so as to smoothly slide along a circumferential edge of the opening 11 of the housing 8. The electric contact portion 42 of each of the male terminals projects from the boss 48 of the case 36 as previously described. The cover 37 is fixed to the back of the case 36 by means of the small screws 45.

Closing the back door from the condition in FIG. 8, the electric contact portions 42 of the male terminal 28 are respectively connected to the female terminals 9 as shown in FIG. 9. Accordingly, the auxiliary members in the back door which are not shown are electrically connected to the power source in the vehicle body and become operable. The shutters 12' are opened outwardly, while the forward ends 25' in an arcuate shape come in contact with the circumferential edge 11*a* of the opening 11, and the intrusion of dusts, etc. into the connector 3 along the edge 11*a* will be prevented. The spring receiving portions 16 of the female terminal 9 are moved away from the support projections 55. The boss 48 provided at the root of the electric contact portion 42 is located just in front of the opening 11.

When the overstroke has occurred as shown in FIG. 10, the boss 48 enters into the opening 11 and stops just in front of the guide faces 26' of the shutters 12'. The forward end of the electric contact portion 42 stops just in front of the support pin 21. In FIGS. 9 and 10, the electric contact portion 42 of the male terminal 28 slidably contacts the contact faces 15*a* of the female terminal 9 thereby to remove dust or abrasion powders from the contact faces 15*a*. In FIG. 10 too, the opening 11 is closed with the shutters 12'. An amount of movement of the spring receiving portions 16 is constant irrespective of a stroke of the male terminal 28, and a contact pressure at the contact portions 15 is also constant.

Figure 11:
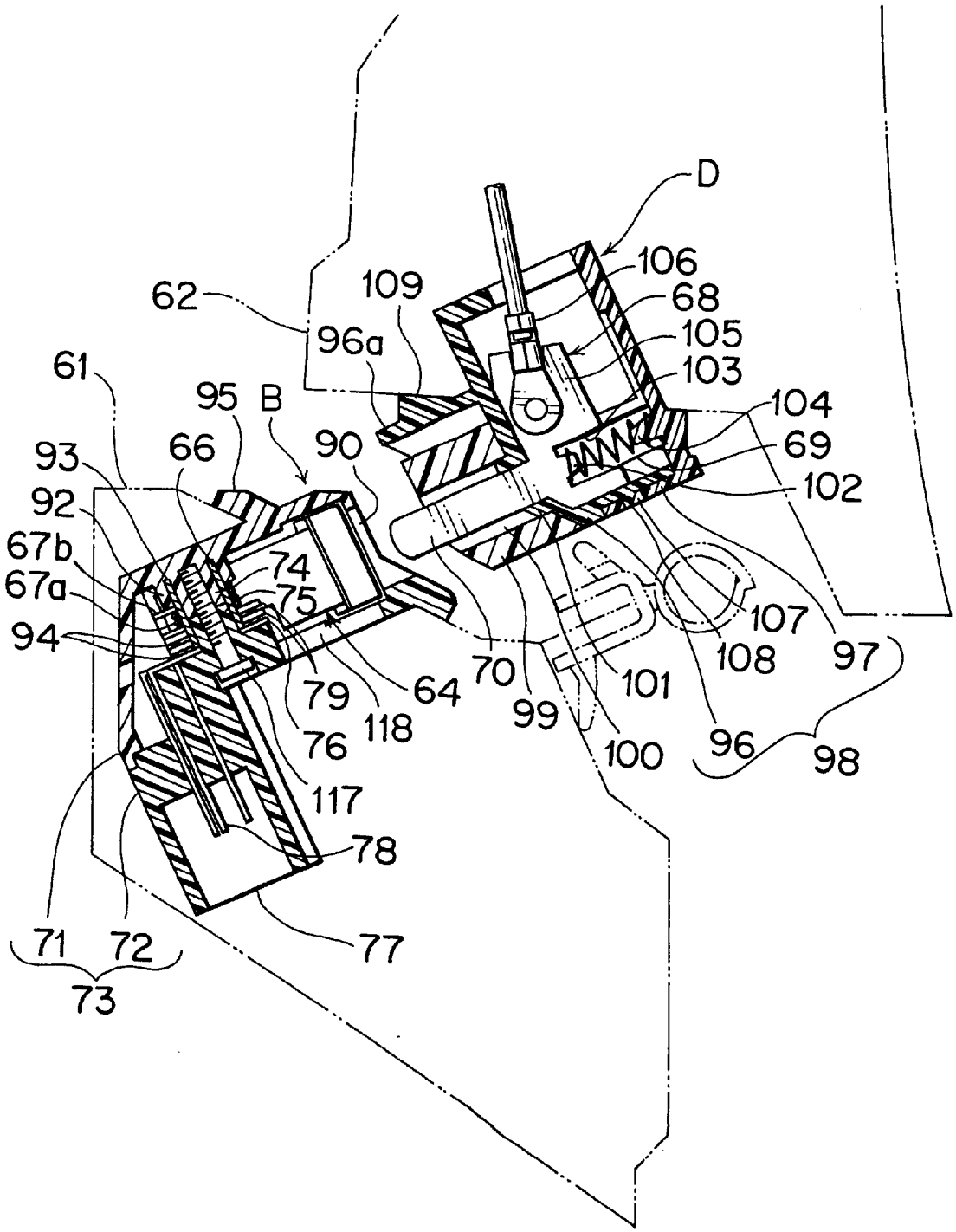
FIG. 11 is a side view in a vertical section showing a second embodiment of the connection structure for power supply to the vehicle door.
Figure 12:
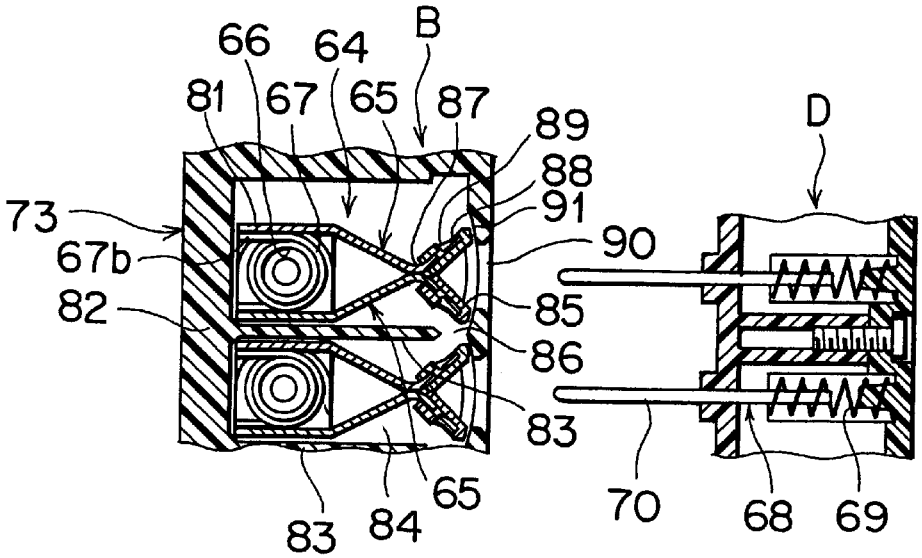
FIG. 12 is a plan view in a longitudinal section showing the connection structure for power supply in FIG. 11.
Figure 13:
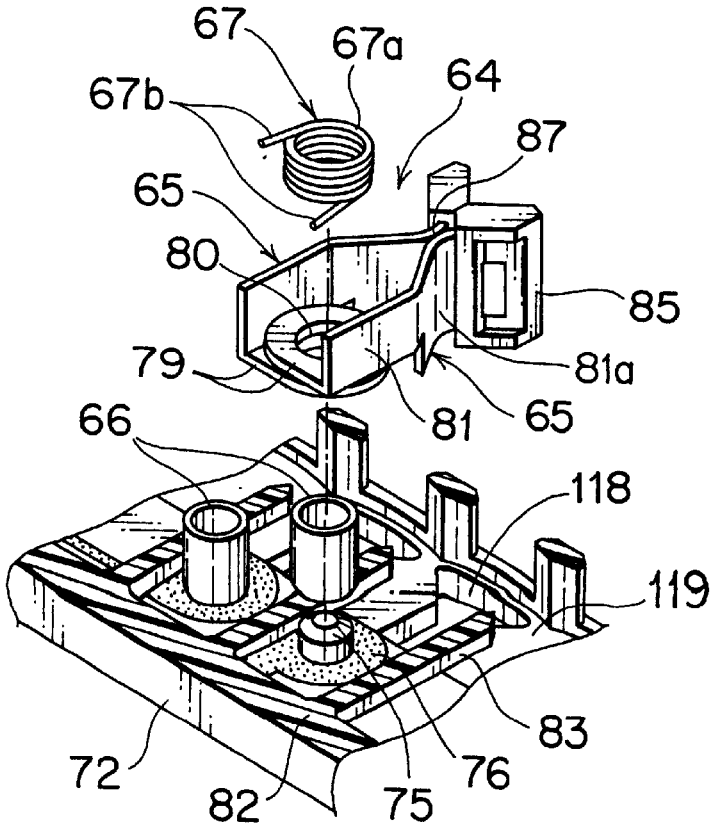
FIG. 13 is an exploded perspective view showing an internal structure of a body side connector in FIG. 12.

FIGS. 11 to 13 show a second embodiment of the connection structure for power supply to the vehicle door according to the invention. The essential members in this embodiment are substantially the same as in the first embodiment, and so, the different points only will be described hereunder.

In FIGS. 11 and 12, reference numeral 61 represents a vehicle body, 62 represents a back door, B represents a body side connector, and D represents a door side connector. A pair of contact members 65, 65 of a female terminal 64 in the body side connector B are supported by a cylindrical shaft (a support shaft) 66 formed of metal so as to be opened and closed. The contact members 65, 65 are biased in a closing direction by a torsion coil spring (a spring member) 67 surrounding the cylindrical shaft 66.

A male terminal 68 of the door side connector D is strongly biased by a compression coil spring 69 in a direction of insertion, and designed so as to be retractable when a plate-like electric contact portion 70 seriously interferes with the exterior. A force of the coil spring 69 is set larger than a force of inserting the electric contact portion 70 into the female terminal 64.

In the body side connector B, a housing 73 is composed of a case 72 and a cover 71 of a synthetic resin which are vertically fitted together. The case 72 and the cover 71 are fixed to each other by means of small screws 117 passing through centers of their respective bosses 74, 75 in a mated state. The above mentioned cylindrical shaft 66 is fitted around the bosses 74, 75.

As shown in FIG. 13, the cylindrical shaft 66 engages with the boss 75 in each of the terminal containing chambers in the case 72. An electrode 76 is provided around the boss 75 in the case 72 and continues as a tab terminal 78 in a female connector 20 portion 77 (FIG. 11). Around the cylindrical shaft 66 is fitted an axial bore 80 of the female terminal 64. The cylindrical shaft 66 serves to prevent sliding wear and deformation of the boss 75 and the axial bore 80. The axial bore 80 is formed in horizontal hinge portions 79 of the contact members 65.

Around the cylindrical shaft 66 is fitted a coiled portion 67*a* of the torsion coil spring 67, and a pair of leg portions 67*b* of the torsion coil spring 67 are abutted against side plate portions (spring receiving portions) 81 of the contact members 65. Partition walls 83 project f rom a back wall 82 of the case 72, and in a chamber defined by the partition walls 83 is disposed each of the female terminals 64. A relief opening 86 for the shutter 85 is defined at a forward end of the partition wall 83.

The leg portions 67*b* of the torsion coil spring 67 push the side plate portions 81 of the contact members 65 outwardly, and push the contact portions 87 and the shutters 85 in a closing direction with an appropriate (not too strong) force. As shown in FIGS. 12, 13, the shutters 85 formed of a synthetic resin are inserted between slanted forward faces 88 of the contact portions 87 and locked by means of locking claws 89. The shutters 85 slide along inwardly curved faces 91 at both sides of an opening 90 in the housing 73 so as to always keep the opening 90 closed.

When an axial displacement has occurred between the female terminal 64 and the electric contact portion 70 of the male terminal 68, the female terminal 64 is rotated about the cylindrical shaft 66 inside the partition walls thereby absorbing the axial displacement. In a case where both the body side and door side connectors B, D are axially displaced from each other, all the female terminals 64 are synchronously rotated inside the partition walls 83.

As shown in FIG. 13, each of the contact members 65 of the female terminal 64 consists of the horizontal hinge portion 79, the side plate portion 81, a slanted portion 91 which is slanted forward from the side plate portion 81, and the contact portion 87 continued from the slanted portion 91. A pair of the hinge portions 79 are stacked and pressed against the electrode 76 by means of the coiled portion 67*a* of the torsion coil spring 67.

In FIG. 13, a pair of the contact portions 87 can be opened horizontally in the same manner as in the previous embodiment, so that dusts between a pair of the contact portions 87 may easily fall down. There are formed openings 118 for draining water and removing dusts in a bottom wall 119 of the case 72 below the female terminals 64. A forward area of the opening 118 is made larger in width according to the shape of the shutters 85 so that the water drops and dusts received by the shutters 85 as well as the dust or the like scraped by abrasion when the male terminal is inserted, may fall through the opening 118 and may not stay in the housing 73.

As shown in FIG. 11, the coiled portion 67*a* is pressed by a seat 92 surrounding the boss 74 of the cover 71. Between the boss 74 and the seat 92 is formed a groove 93 into which the cylindrical shaft 66 is inserted. The upper hinge portion 79 and the electrode 76 are provided with contacts 94, and the lower hinge portion 79 is in contact with the electrode 76. The housing 73 is fixed to the vehicle body 61 by means of a flange 95 in the same manner as in FIG. 2. In this embodiment, since the torsion coil spring 67 serves to press the contact portions 87 and also to press the hinge portions 79 against the electrode 76, it is not necessary to provide the bellville spring 30 as in the first embodiment, and the manufacturing cost can be saved.

In FIGS. 11 and 12, the door side connector D includes a cushion 99 in a front part of a case 96 so as to face with the body side connector B. The electric contact portion 70 of the male terminal 68 passes through a hollow part 100 in the cushion 99 and a distal end of the electric contact portion 70 projects outward of the cushion 99. The electric contact portion 70 projects from a boss 101 of the case 96, and the hollow part 100 of the cushion 99 is fitted around the boss 101. The case 96 is integrally formed with a hood 96*a* which covers a front part of the body side housing 73 outside the cushion 99.

The electric contact portion 70 is formed at a base part thereof with a projection 102 for receiving a spring, and a cutout 103 into which the coil spring is inserted. Between the spring receiving projection 102 and a spring receiving projection 104 of the cover 97 is resiliently provided a compression spring 69. The male terminal 68 is adapted to compress the coil spring 69 to retract the electric contact portion 70 inwardly of the cushion 99 when the electric contact portion 70 has received an accidental outer force. This action will prevent the electric contact portion 70 from being deformed or broken.

The male terminal 68 has a connecting portion 105 which extends upwardly from the base part of the electric contact portion 70, and a terminal 106 provided with an electric wire (wire harness) is connected to the connecting portion 105 by means of screws or the like. The cover 97 is fixed to the case 96 by engaging a locking projection 108 in the case 96 with a locking hole 107 in the cover 97. The housing 98 is fixed to the back door 62 by means of a flange portion 109.

In the structure of the above described embodiments, it is possible to replace the door side connector D with the body side connector B in such a manner that the door side connector D may be provided in the vehicle body and the body side connector B in the door. It is also possible that the first and the second embodiments can be constructed with their characteristic parts exchanged with each other. Moreover, the above described structures can be applied not only to the back door but also to a front and a rear doors of the vehicle.

As described above, in the connection structure for connecting a power supply to the vehicle door according to the invention, the contact faces can be kept clean without attachment or accumulation of dust or water drops thereon. There is no need of providing a movable mechanism to deal with the overstroke, and the structure can be downsized. Further, the contact portions of the terminals are free from faulty contacts caused by radial displacements therebetween.

What is claimed is:

1. A connection structure for connecting a power supply to a vehicle door comprising: a door side connector and a body side connector to be engaged with each other to interconnect door side and body side electric circuits, either one of said door side connector and said body side connector being formed with a housing containing openings and being provided with female terminals, and the other of said door side connector and said body side connector being provided with male terminals, each of said female terminals including contact members having a pair of contact portions with their forward ends pivotally movable in a horizontal direction between open and closed positions adjacent a housing opening about a pivot spaced from said housing opening, a spring member normally biasing said contact members in a closing direction, wherein to connect said connector each male terminal is inserted through said opening and between the forward ends of a pair of said contact portions.

2. The connection structure for power supply to the vehicle door as claimed in claim 1, wherein said pair of said contact portions are provided with shutters at their respective forward ends, each of said shutters being disposed adjacent said housing opening and being substantially contiguous when closed to fill said housing opening thereby to close said opening formed in said housing for receiving said male terminal.

3. The connection structure for connecting a power supply to the vehicle door as claimed in claim 2, wherein said connector is provided with openings for draining water and removing dust from beneath said contact portions and said shutters.

4. The connection structure for connecting a power supply to the vehicle door as a claimed in any one of claims 1 to 3, wherein said female terminal is pivotally supported by a support shaft.

5. The connection structure for connecting a power supply to the vehicle door as claimed in claim 4, wherein said female terminal includes a hinge carrying a pair of hinge portions which are mutually biased by tension of a spring against an electrode in said male terminal, said electrode being connected to either of the door side circuit and the body side circuit.

6. The connection structure for connecting a power supply to the vehicle door as claimed in claim 5, wherein said male terminal is biased by tension of a spring in a projecting direction with a larger force than a force of inserting it into said female terminal and is retractable on occasion of an interference.

* * * * *